US006735323B1

(12) United States Patent
Chang

(10) Patent No.: US 6,735,323 B1
(45) Date of Patent: May 11, 2004

(54) SPEAKER

(75) Inventor: George Chang, Tainan (TW)

(73) Assignee: Sun Technique Electric Co., Ltd., Fengshan (TW)

( * ) Notice: Subject to any disclaimer, the term of this patent is extended or adjusted under 35 U.S.C. 154(b) by 0 days.

(21) Appl. No.: 10/354,020

(22) Filed: Jan. 30, 2003

(51) Int. Cl.[7] ..... H04R 25/00
(52) U.S. Cl. ..... 381/404; 403/398
(58) Field of Search ..... 381/396, 398, 381/400, 401, 403, 404, 405, 410, 423, 424, 432; 181/171, 172; 29/594, 609.1

(56) References Cited

U.S. PATENT DOCUMENTS 2,295,483 A * 9/1942 Knowles ..... 381/404
3,767,004 A * 10/1973 Liebscher ..... 181/172
6,031,925 A * 2/2000 Shteyn ..... 381/401
6,173,065 B1 * 1/2001 Lin ..... 381/398

* cited by examiner

*Primary Examiner*—Huyen Le
(74) *Attorney, Agent, or Firm*—Bacon & Thomas, PLLC

(57) ABSTRACT

A speaker includes a T-shape iron, a ring magnet, a pole plate, a frame, a diaphragm, a coil core portion, a voice coil, a first annular corrugated plate, and at least one second annular corrugated plate. The second annular corrugated plate has is bonded to an inner side or an outer side of an outer section of the first annular corrugated plate and spaced from the coil core portion, thereby increasing a thickness and strength of an outer section of the first annular corrugated plate for bearing higher power such that the speaker generates clear sound and that an inner section of the first annular corrugated plate generates sufficient sound pressure when a power outputted by the speaker is low.

5 Claims, 4 Drawing Sheets

SPEAKER

BACKGROUND OF THE INVENTION

1. Field of the Invention

The present invention relates to a speaker that can produce excellent sound quality as well as sufficient sound pressure regardless of the power value by means of providing at least one additional annular corrugated plate.

2. Description of Related Art

FIGS. 1 and 2 of the drawings illustrate two typical conventional speakers. As illustrated in FIG. 1, the speaker includes a T-iron 10, a ring magnet 11 mounted around a central protrusion 101 projecting from a central portion of the T-iron 10, a pole plate 12 mounted on top of the ring magnet 11 and spaced from the central protrusion 101 of the T-iron 10, a frame 13 mounted on top of the pole plate 12, a diaphragm 15 supported by an edge 131 of the frame 13, a coil core portion 14 surrounding the central protrusion 101 of the T-iron 10, a voice coil 141 wound around the coil core portion 14 and spaced from the pole plate 12, and an annular corrugated plate 16 which is mounted around and supports the coil core portion 14. The voice coil 141, when energized, generates vibration waves for causing the annular corrugated plate 16 and the diaphragm 15 to vibrate. The annular corrugated plate 16 is provided for showing the bass of the sound. The speaker of FIG. 2 is similar to that of FIG. 1, except that an additional annular corrugated plate 16 is provided.

The damping strength of the annular corrugated plate 16 affects the restoration and the resonance frequency of the coil core portion 14; namely, the effectiveness of oppressing inertial damping by annular corrugated plate 16 affects the power and sound pressure (volume) withstandable by the speaker. Thus, the number of the annular corrugated plates 16 for a speaker depends on the power. A speaker having only one annular corrugated plate 16 shown in FIG. 1 may produce clear sound when the power is low, but the effectiveness of oppressing inertial damping by the annular corrugated plate 16 drops when the power is high, as the restoration force and strength of the annular corrugated plate 16 are insufficient. As a result, the annular corrugated plate 16 overvibrates and the sound quality is lost. On the other hand, a speaker having two annular corrugated plates 16 shown in FIG. 2 solves the problems encountered in high power situation, but the restoration force and the damping are too large when the power is low, resulting in insufficient sound pressure (the volume is too low). The dilemma in sound quality for high power and lower power is a bottleneck to speakers.

OBJECTS OF THE INVENTION

An object of the present invention is to provide a speaker that can produce excellent sound quality as well as sufficient sound pressure regardless of the power value by means of providing at least one additional annular corrugated plate. The strength and the restoration force of the whole annular corrugated plate are increased such that the speaker may bear higher power and maintain the volume.

SUMMARY OF THE INVENTION

A speaker in accordance with the present invention includes a T-shape iron having a central protrusion on a central portion thereof, a ring magnet mounted around the central portion of the T-shape iron, a pole plate mounted on top of the ring magnet and spaced from the T-shape iron, a frame mounted above the pole plate, a diaphragm mounted to the frame, a coil core portion mounted around the central protrusion of the T-shape iron, a voice coil wound around the voice core portion, a first annular corrugated plate mounted around the voice core portion and spaced from the voice coil, the first annular corrugated plate having an inner section adjacent to the coil core portion and an outer section distal to the coil core portion, and at least one second annular corrugated plate. The second corrugated plate is bonded to an inner side or an outer side of the outer section of the first annular corrugated plate and spaced from the coil core portion, thereby increasing a thickness and strength of the outer section of the first annular corrugated plate for bearing higher power such that the speaker generates clear sound and that the inner section of the first annular corrugated plate generates sufficient sound pressure when a power outputted by the speaker is low. The second annular corrugated plate has an inner diameter greater than that of the first annular corrugated plate.

The diaphragm includes an outer periphery that is bonded to an edge of the frame, and a reinforcing plate is bonded to an outer side of the edge of the frame.

In an embodiment of the invention, a second annular corrugated plate and a third annular corrugated plate are bonded to the outer section of the first annular corrugated plate and spaced from the coil core portion, thereby increasing a thickness and strength of the outer section of the first annular corrugated plate for bearing higher power such that the speaker generates clear sound and that the inner section of the first annular corrugated plate generates sufficient sound pressure when a power outputted by the speaker is low.

Other objects, advantages and novel features of this invention will become more apparent from the following detailed description when taken in conjunction with the accompanying drawings.

DETAILED DESCRIPTION OF THE PREFERRED EMBODIMENTS

The present invention is now to be described hereinafter in detail, in which the same referential numerals are used for the same parts as those in the prior art.

Figure 1:
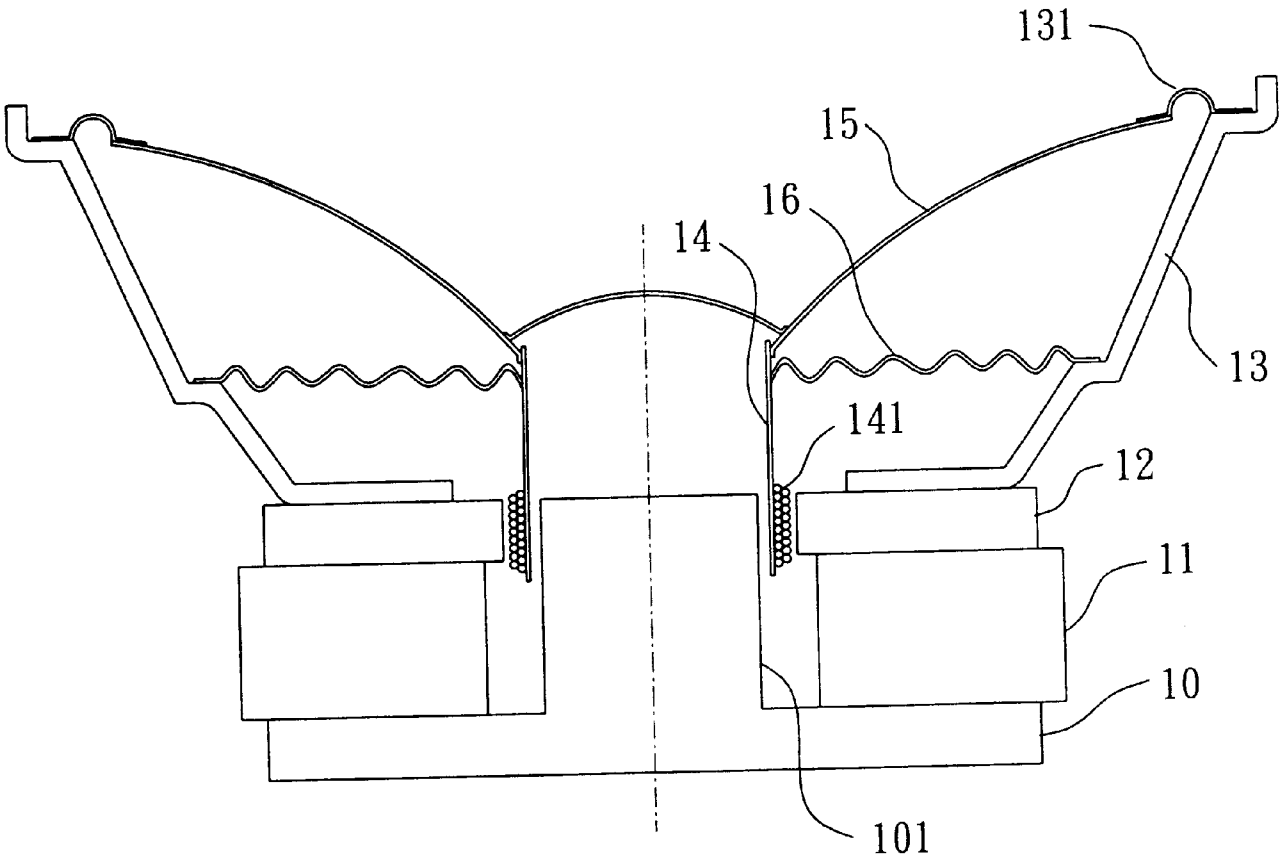
FIG. 1 PRIOR ART
FIG. 1 is a sectional view of a conventional speaker.
Figure 2:
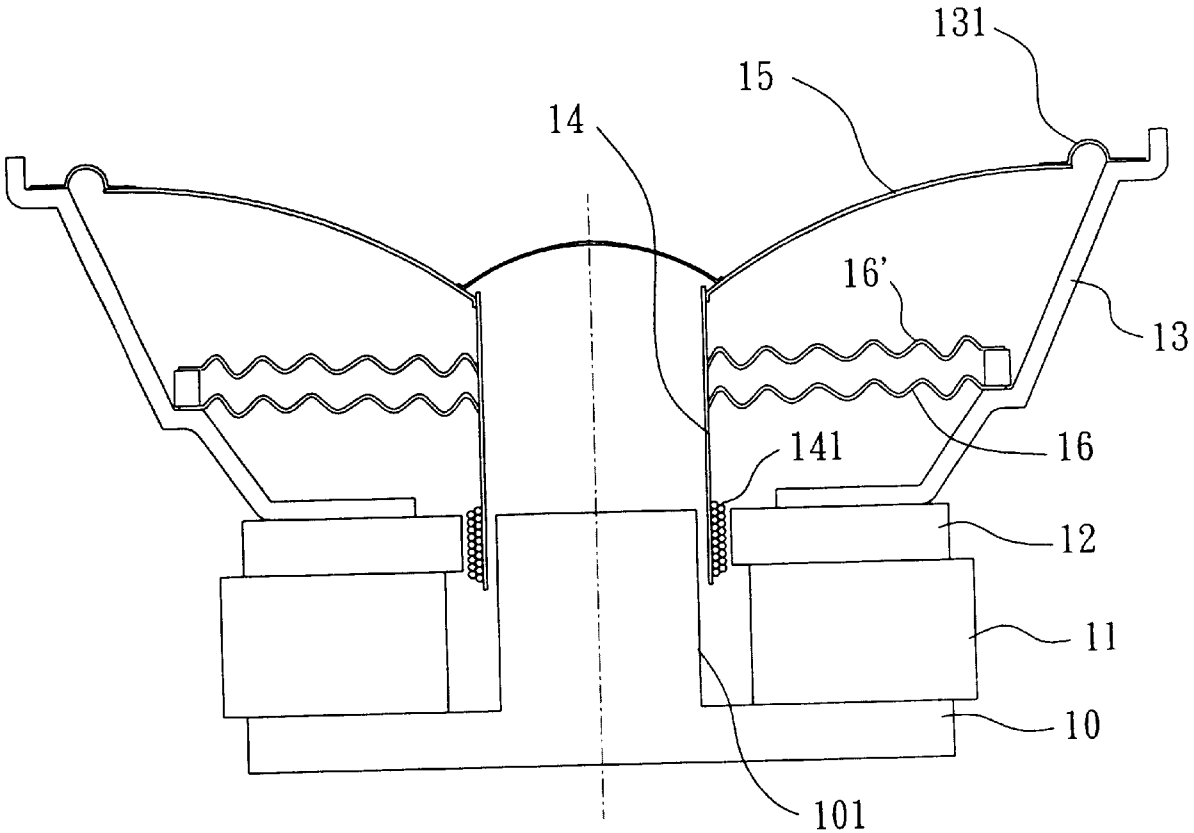
FIG. 2 PRIOR ART
FIG. 2 is a sectional view of another conventional speaker.
Figure 3:
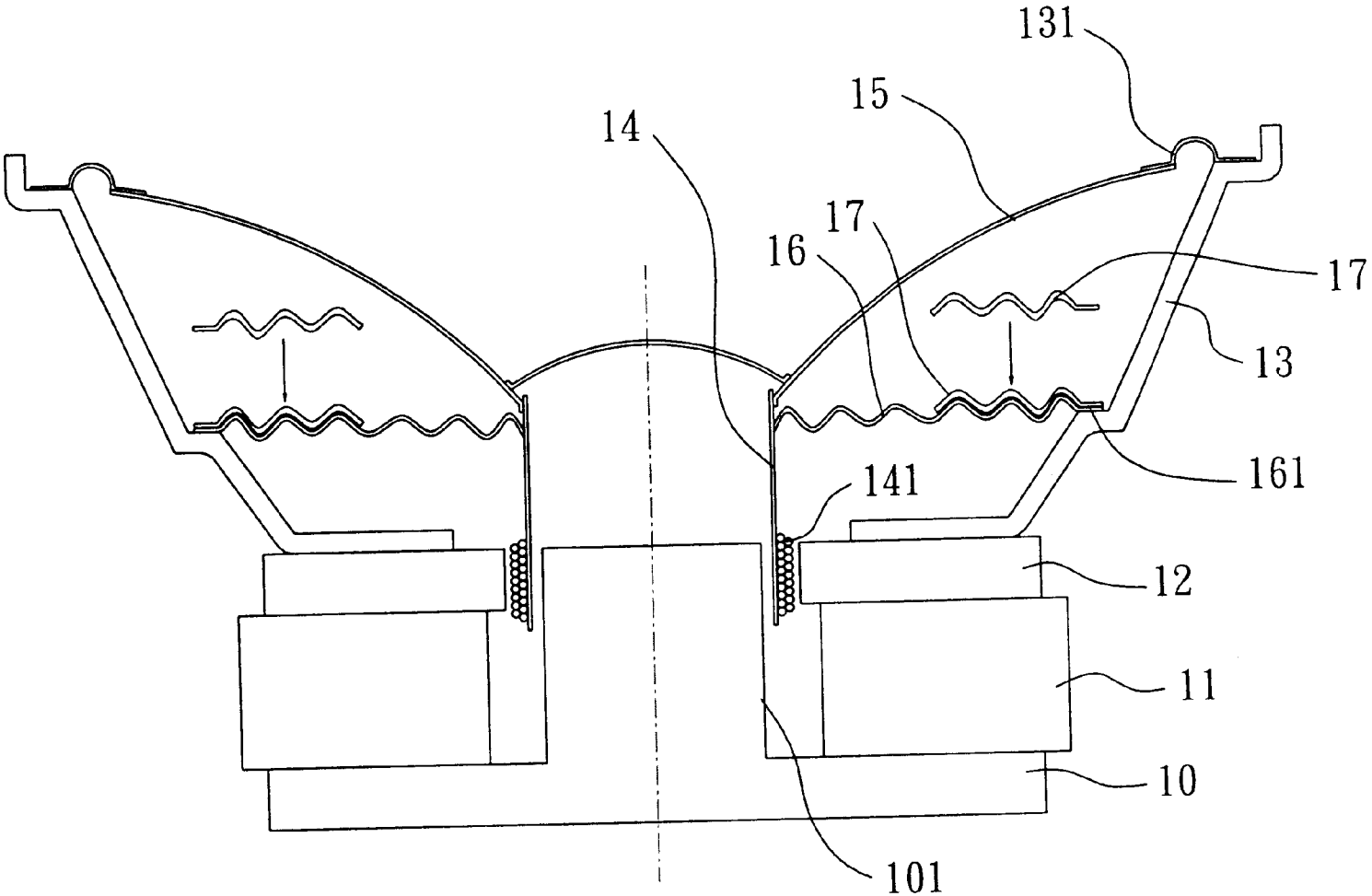
FIG. 3 is a sectional view of a speaker in accordance with the present invention.

Referring to FIG. 3, a speaker in accordance with the present invention includes a T-iron 10, a ring magnet 11 mounted around a central protrusion 101 projecting from a central portion of the T-iron 10, a pole plate 12 mounted on top of the ring magnet 11 and spaced from the central protrusion 101 of the T-iron 10, a frame 13 mounted on top of the pole plate 12, a diaphragm 15 supported by an edge 131 of the frame 13, a coil core portion 14 surrounding the central protrusion 101 of the T-iron 10, a voice coil 141 wound around the coil core portion 14 and spaced from the pole plate 12, and a first annular corrugated plate 16 which is mounted around and supports the coil core portion 14. The voice coil 141, when energized, generates vibration waves for causing the first annular corrugated plate 16 and the diaphragm 15 to vibrate. The first annular corrugated plate 16 is provided for showing the bass of the sound and includes an inner periphery bonded to the coil core portion 14 and an outer periphery 161 bonded to the frame 13. The first annular corrugated plate 16 includes an inner section adjacent to the coil core portion 14 and an outer section distal to the coil core portion 14.

Of more importance, at least one second annular corrugated plate 17 is mounted to one of an inner side and an outer side of the first annular corrugated plate 16. In the embodiment shown in FIG. 3, a second annular corrugated plate 17 having an inner diameter greater than that of the first annular corrugated plate 16 is bonded to the outer section of the outer side (upper side in FIG. 3) of the first annular corrugated plate 16 and spaced from the coil core portion 14. Thus, the thickness and the strength of the first annular corrugated plate 16 are increased at the outer section thereof to which the second annular corrugated plate 17 is bonded. Namely, the inner section of the first annular corrugated plate 16 has a smaller restoration force and a lower effectiveness in oppressing inertial damping, and the outer section the first annular corrugated plate 16 has a larger restoration force and a greater effectiveness in oppressing inertial damping.

When the output power of the speaker is low, the inner section of the first annular corrugated plate 16 produces clear sound. The inner section of the first annular corrugated plate 16 receives the energy of the vibration waves generated by the voice coil 141 and generates resonance together with the diaphragm 15, thereby generating sound waves having sufficient sound pressure.

On the other hand, when the output power of the speaker is high, the outer section of the first annular corrugated plate 16 produces clear sound with the help of the second annular corrugated plate 17. More particularly, the excessive energy of the vibration waves that cannot be received by the inner section of the first annular corrugated plate 16 are received by the outer section of the first annular corrugated plate 16 and the second annular corrugated plate 17 bonded to the outer section of the first annular corrugated plate 16, and the whole first annular corrugated plate 16 (including the second annular corrugated plate 17) cooperates with the diaphragm 15 to provide resonance without sacrificing the quality. Thus, the speaker in accordance with the present invention may generate excellent sound quality and sufficient sound pressure regardless of the output power, which is a breakthrough in speakers.

The second annular corrugated plate 17 can be made from a material different from that for the first annular corrugated plate 16, and the thicknesses of the first annular corrugated plate 16 and the second annular corrugated plate 17 can be altered.

Figure 4:
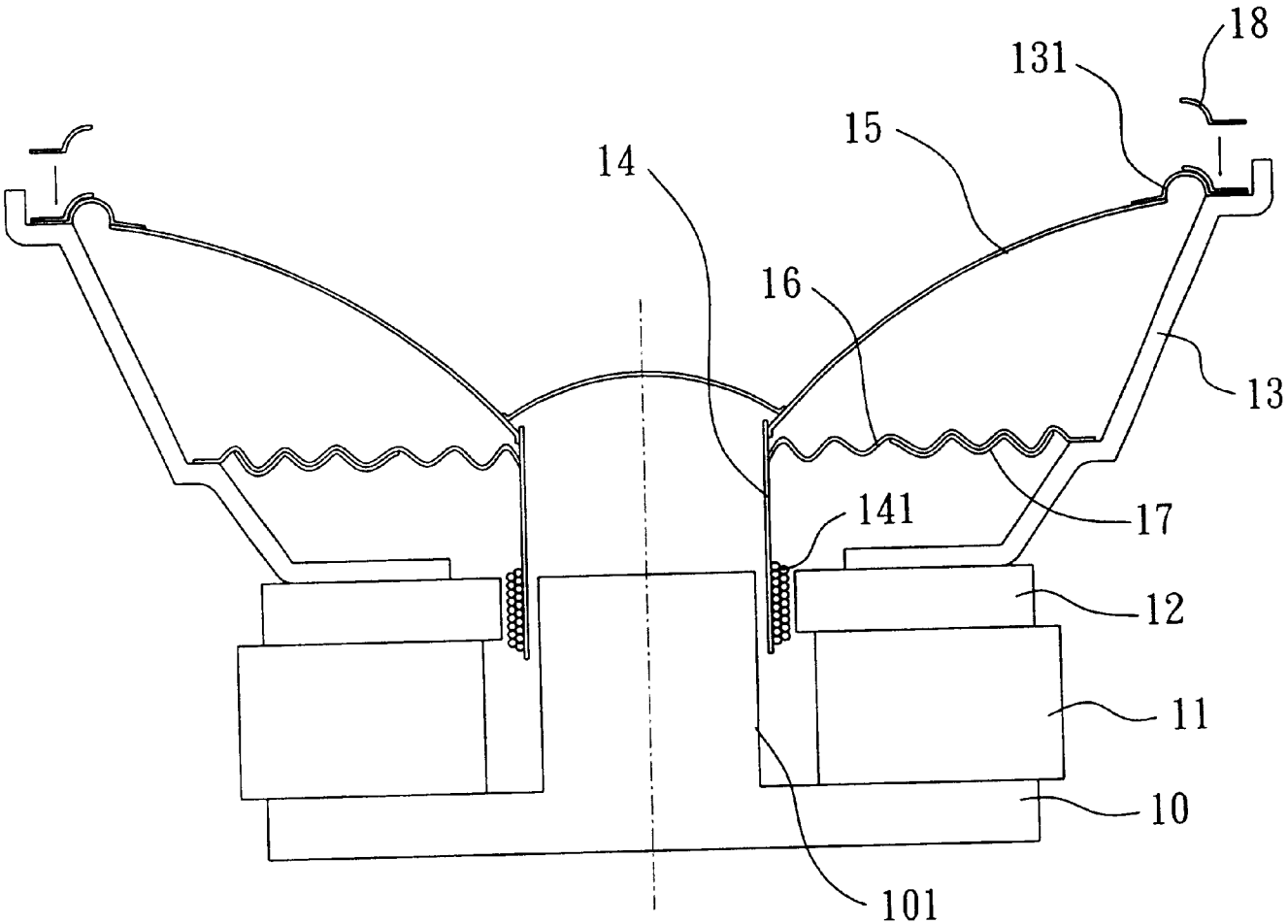
FIG. 4 is a sectional view of another embodiment of the speaker in accordance with the present invention.

FIG. 4 illustrates another embodiment of the speaker in accordance with the present invention, wherein the second annular corrugated plate 17 is bonded to an outer section of an inner side of the first annular corrugated plate 16. Operation of the speaker is substantially the same as that of the first embodiment of FIG. 3. Further, in order to increase the power-bearing capacity of the speaker and to maintain the sound pressure, an annular reinforcing plate 18 is securely attached to the edge 131 of the frame 13. The annular reinforcing plate 18 is configured to have a shape and curvature substantially the same as those of an outer portion of the edge 131, and the annular reinforcing plate 18 is bonded to the outer portion of the edge 131, as shown in FIG. 4. The annular reinforcing plate 18 increases the supporting strength for the speaker, thereby increasing the power-bearing capacity of the speaker (i.e., the speaker may output higher power) and maintaining the sound pressure at a sufficient level.

While the principles of this invention have been disclosed in connection with specific embodiments, it should be understood by those skilled in the art that these descriptions are not intended to limit the scope of the invention, and that any modification and variation without departing the spirit of the invention is intended to be covered by the scope of this invention defined only by the appended claims.

What is claimed is:

1. A speaker comprising:

a T-shape iron having a central protrusion on a central portion thereof;

a ring magnet mounted around the central portion of the T-shape iron;

a pole plate mounted on top of the ring magnet and spaced from the T-shape iron;

a frame mounted above the pole plate;

a diaphragm mounted to the frame;

a coil core portion mounted around the central protrusion of the T-shape iron;

a voice coil wound around the coil core portion;

a first annular corrugated plate mounted around the coil core portion and spaced from the voice coil, the first annular corrugated plate having an inner section adjacent to the coil core portion and an outer section distal to the coil core portion; and at least one second annular corrugated plate bonded to one of an inner side and an outer side of the outer section of the first annular corrugated plate and spaced from the coil core portion, thereby increasing a thickness and strength of the outer section of the first annular corrugated plate for bearing higher power such that the speaker generates clear sound and that the inner section of the first annular corrugated plate generates sufficient sound pressure when a power outputted by the speaker is low, said at least one second annular corrugated plate having an inner diameter greater than that of the first annular corrugated plate.

2. The speaker as claimed in claim 1, wherein said second annular corrugated plate is bonded to the outer side of the first annular corrugated plate.

3. The speaker as claimed in claim 1, wherein said second annular corrugated plate is bonded to the inner side of the first annular corrugated plate.

4. The speaker as claimed in claim 1, wherein the diaphragm includes an outer periphery that is bonded to an edge of the frame, further including a reinforcing plate bonded to the edge of the frame.

5. The speaker as claimed in claim 4, wherein the reinforcing plate is bonded to an outer side of the edge of the frame.

* * * * *